US007204535B2

(12) United States Patent
Hansen

(10) Patent No.: US 7,204,535 B2
(45) Date of Patent: Apr. 17, 2007

(54) LIFTING APPARATUS

(76) Inventor: David Keith Hansen, 28187 U.S. Hwy. 14/34, Ft. Pierre, SD (US) 57532

( * ) Notice: Subject to any disclaimer, the term of this patent is extended or adjusted under 35 U.S.C. 154(b) by 135 days.

(21) Appl. No.: 10/947,623

(22) Filed: Sep. 21, 2004

(65) Prior Publication Data

US 2006/0061113 A1 Mar. 23, 2006

(51) Int. Cl.
*B66C 1/42* (2006.01)

(52) U.S. Cl. ..... 294/103.1; 294/88; 414/23; 414/745.2

(58) Field of Classification Search ..... 294/67.33, 294/119.1, 103.1, 104, 88; 414/23, 456, 414/745.2, 733, 734
See application file for complete search history.

(56) References Cited

U.S. PATENT DOCUMENTS 2,390,293 A * 12/1945 Colson ..... 294/86.41
3,110,477 A * 11/1963 Campbell ..... 254/132
3,333,717 A * 8/1967 Scaperotto ..... 414/741
3,921,730 A * 11/1975 Farre et al. ..... 173/46
4,051,966 A * 10/1977 Cotton ..... 414/428
4,256,286 A * 3/1981 Hudgins ..... 254/30
4,256,429 A * 3/1981 Dwyer ..... 414/626
4,275,479 A * 6/1981 Korhonen ..... 452/187
4,305,692 A * 12/1981 Brauer ..... 414/816
4,398,761 A * 8/1983 Hanson et al. ..... 294/104
4,951,990 A * 8/1990 Hollan et al. ..... 294/119.1
5,184,934 A * 2/1993 Gallo ..... 414/740
6,382,594 B1 * 5/2002 Ransom ..... 254/30

* cited by examiner

*Primary Examiner*—Dean J. Kramer
(74) *Attorney, Agent, or Firm*—Herbert R. Schulze

(57) ABSTRACT

Apparatus for gripping and lifting objects such as fence posts. A frame carries a pair of grippers that are slidingly movable along the frame to grasp a post or other object. The grippers may pivot so that the object remains in essentially constant vertical orientation despite arcuate motion of a tractor or other lifting machine by which the frame is lifted. The grippers may be actuated by hydraulic or other power provided by the lifting machine.

15 Claims, 3 Drawing Sheets

Post Puller Assembly

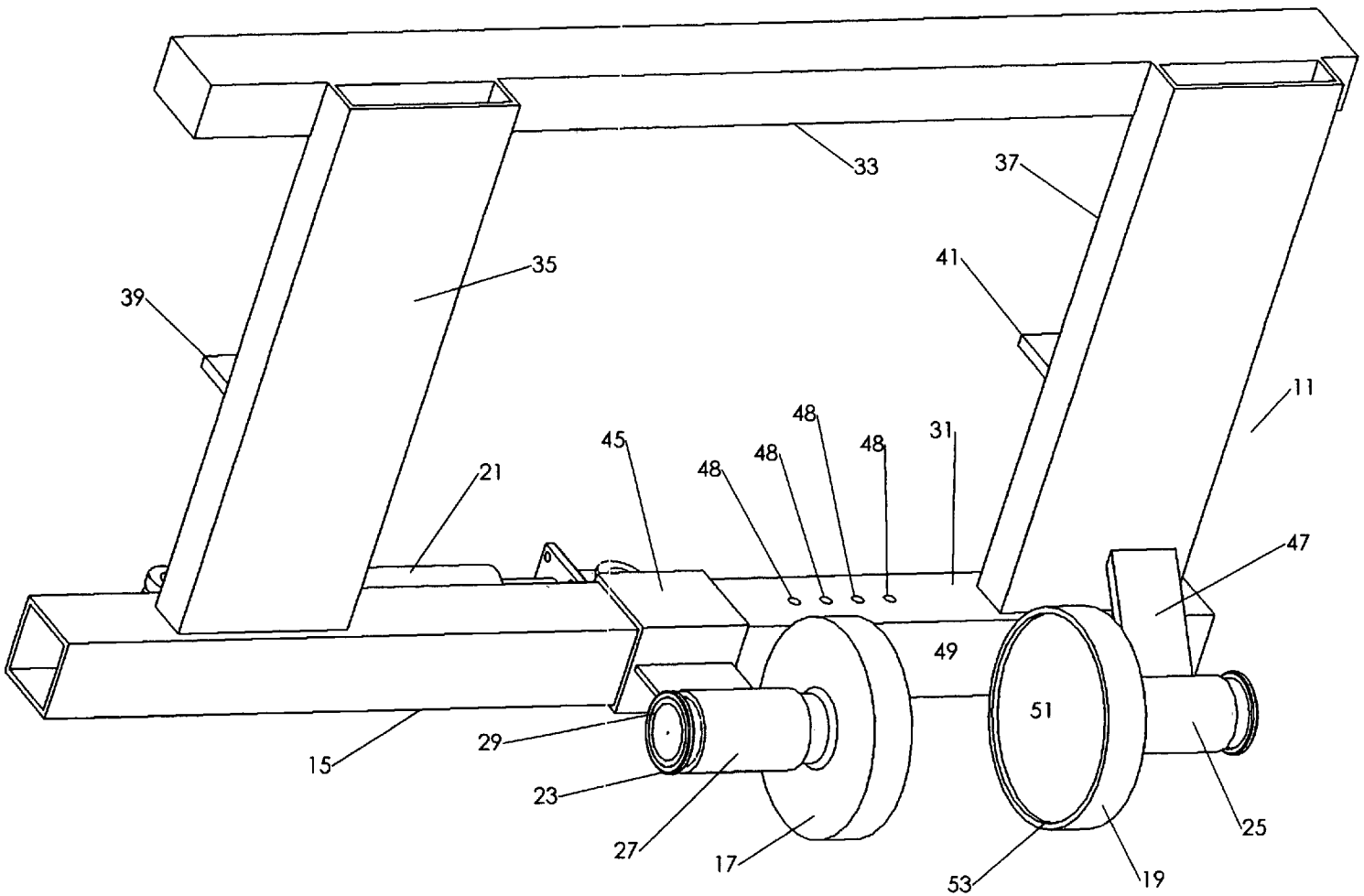
FIG. 1 Post Puller Assembly

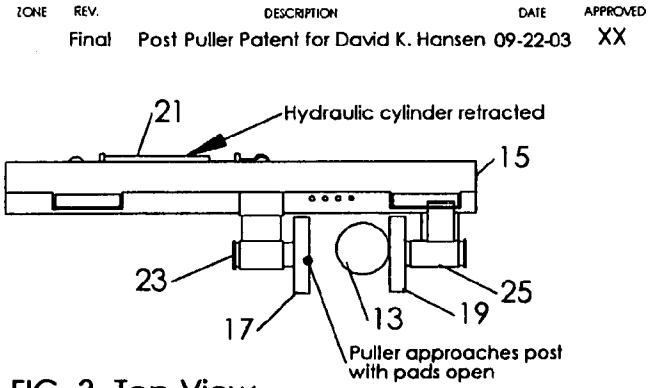
FIG. 3 Top View
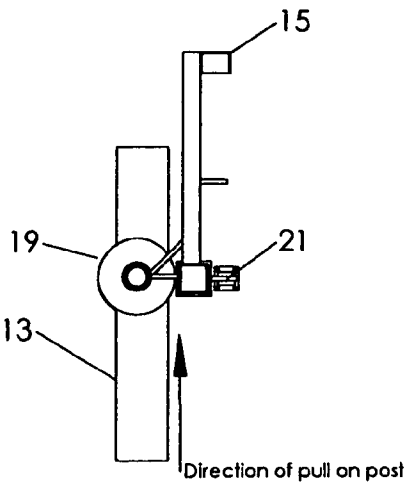
FIG. 5 Side View
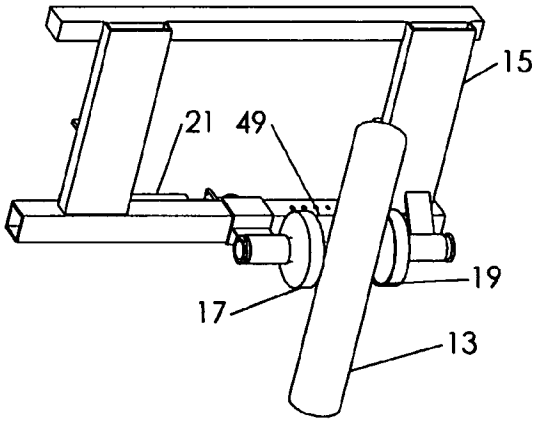
FIG. 2 Isometric View
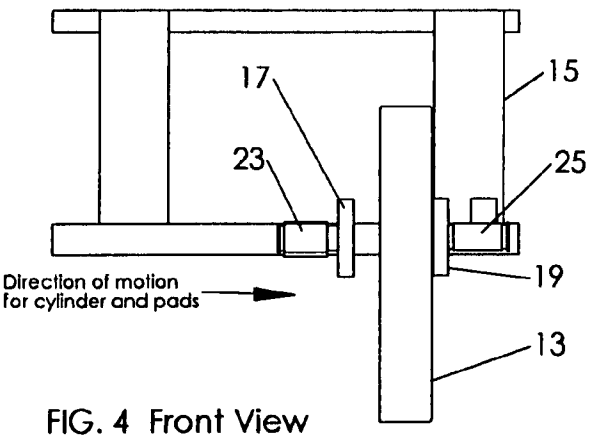
FIG. 4 Front View

LIFTING APPARATUS

BACKGROUND

There are countless applications for an apparatus that can grasp and lift a heavy or awkward workpiece. One example is a post puller that grasps an elongated object such as a fence post or a telephone pole and lifts it out of a post hole or positions it in a post hole or simply moves it about from place to place. A typical post puller consists of some type of clamp that is attached to a machine with lifting power, for example a tractor or a skid-steer loader. The clamp may be nothing more complex than a length of heavy chain that is wrapped tightly around the post, securing the post to the lifting machine. Such a clamp enables a remotely located worker such as a farmer with no power machinery other than a tractor to use the power lifting capacity of the tractor to place and remove fence posts or other awkward or heavy objects.

A chain used as a clamp may require a person to hold the chain securely around the post during the lifting and moving operation. If the chain is attached to a tractor with lifting capability, it may be possible for one person to simultaneously hold the chain and operate the tractor, but at best this is clumsy, and it often poses safety issues, so a second person may be needed. Lifting machines such as tractors or skid-steer loaders generally lift by pivoting about a point, and this results in the lifting motion being arcuate rather than linear. When inserting a post into, or removing it from, a deep post hole, an arcuate lifting motion can cause the post to bind against the walls of the hole, damaging the hole or the post or rendering the lifting operation impossible.

Accordingly, there has been a need for a lifting apparatus that can easily be attached to a lifting machine in a remote location, that can safely and conveniently be operated by a sole worker, and that can lift clumsy or heavy objects. It would be desirable for such an apparatus to lift an object through a linear rather than an arcuate range of motion.

SUMMARY OF THE INVENTION

The invention provides a lifting apparatus that attaches to a lifting machine and enables the machine to lift a heavy or awkward object under control of one person. In some aspects this lifting apparatus lifts heavy or awkward objects through a linear range of motion.

In some aspects the invention provides a lifting apparatus that includes a liftable frame, a first gripper slidingly carried by the frame, a second gripper carried by the frame, and an actuator that urges the first gripper slidingly toward the second gripper to grip a workpiece between the two grippers. In some aspects the lifting apparatus is adapted for attachment to a machine with lifting power such as a tractor or skid-steer loader. The actuator may be operated by hydraulic, pneumatic, electrical, or other power drawn from the machine. In some aspects the grippers are pivotingly mounted such that they pivot as the frame is lifted, thereby maintaining the workpiece in an approximately constant angular orientation despite any arcuate motion of the lifting apparatus.

Other aspects and advantages of the invention will become apparent from the following description, taken in conjunction with the accompanying drawings, illustrating by way of example the principles of the invention.

BRIEF DESCRIPTION OF THE DRAWINGS

FIG. 1 provides a perspective view of a lifting apparatus embodying the invention.

FIG. 2 provides an isometric view of a lifting apparatus embodying the invention, showing a workpiece positioned between the grippers.

FIG. 3 provides a top view of a lifting apparatus embodying the invention.

FIG. 4 provides a front view of a lifting apparatus embodying the invention.

FIG. 5 provides a side view of a lifting apparatus embodying the invention.

DETAILED DESCRIPTION

Figure 6:
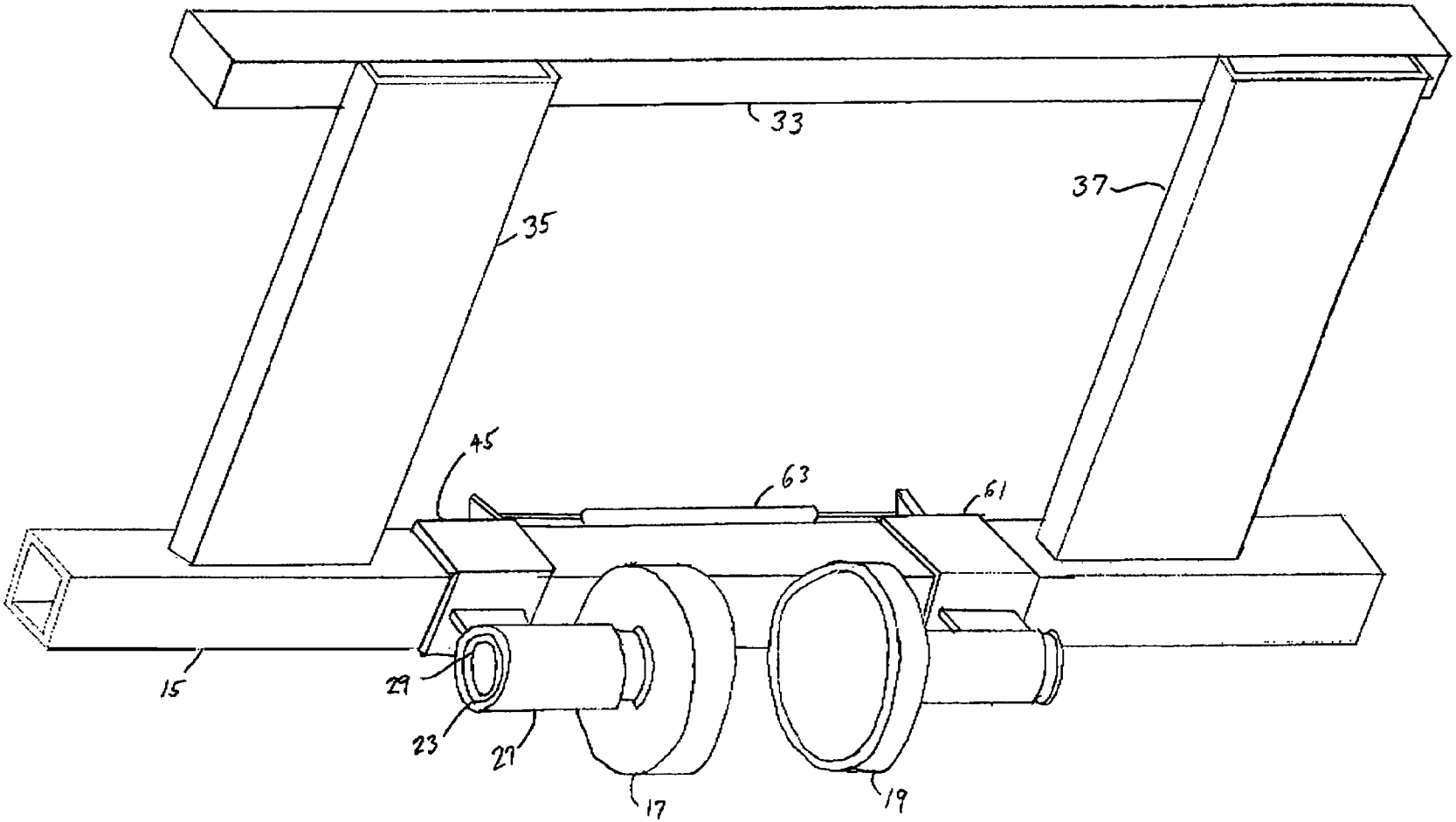
FIG. 6 provides a side view of an alternate embodiment of the invention.

As shown in the drawings for purposes of illustration, the invention is embodied in a lifting apparatus that attaches to a lifting machine and enables the machine to lift a heavy or awkward workpiece under control of one person, in some aspects lifting the workpiece through a linear range of motion. Various ways of clamping a workpiece to a lifting machine have been used, but these have required more than one person for safe and convenient operation or have lifted the workpiece through an arcuate range of motion.

In the following detailed description and in the several figures of the drawings, like elements are identified with like reference numerals.

In some embodiments the invention provides an apparatus generally 11 for lifting a workpiece such as a fence post 13. The apparatus includes a liftable frame 15, a first gripper 17 slidingly carried by the frame, a second gripper 19 carried by the frame, and a hydraulic actuator 21 that urges the first gripper slidingly toward the second gripper to grip the workpiece between the two grippers whereby the workpiece is lifted when the frame is lifted. In one embodiment a first pivoting mount 23 is provided between the first gripper and the frame, and a second pivoting mount 25 is provided between the second gripper and the frame. As best shown in FIG. 1, the first pivoting mount 23 may comprise a sleeve 27 carried by the frame and a shaft 29 rotatably disposed in the sleeve. The second pivoting mount may be constructed in a similar fashion.

A pneumatic actuator, an electric motor, or some other device may be used rather than the hydraulic actuator 21. Although a separate power supply such as a hydraulic pump, an air compressor, or the like could be used to power the actuator, the actuator can conveniently be powered directly from the lifting machine. For example, a tractor with a hydraulic system can provide the hydraulic power to operate the actuator.

In some embodiments the frame 15 is adapted to be lifted by a lifting element of a vehicle such as a tractor or a skid-steer loader (not shown). For example, in the embodiment illustrated, the frame 15 is constructed of a lower cross member 31, an upper cross member 33, a first vertical member 35 and a second vertical member 37, the four members defining a generally rectangular shape. A first engagement member 39 is attached to the first vertical member 35 and a second engagement member 41 is attached to the second vertical member 37. The lifting element of the vehicle engages the two engagement members to lift the frame 15. Or the vehicle may be connected to the frame in some other manner.

In some embodiments the first gripper 17 is slidingly mounted to the frame 15. This may be done by attaching the sleeve 27 to a sliding unit 45 that slides along the lower cross member 31.

In the embodiment shown, the second gripper 19 is fixedly attached to the frame 15 through a mount 47. In other embodiments the second gripper is slidingly mounted to the frame 15, for example by means of a sliding unit similar to the sliding unit 45. In such embodiments the actuator 21 may be connected between the two grippers rather than between one gripper and the frame, such that the actuator urges the two grippers toward each other.

To use the apparatus to extract a post such as the post 13 from a hole in the ground, the operator maneuvers the lifting machine so as to place the second gripper 19 against one edge of the post and a front surface 49 of the lower cross member 31 against the back of the post as best shown in FIG. 2. At this point the operator stops forward motion of the lifting machine. Then the operator deploys the first gripper 17 laterally to make contact with the post, pushing the post against the second gripper 19. Pressure exerted on the post by the first gripper clamps the post against the second gripper. Once this is done the operator causes the lifting machine to lift up. This raises the frame, lifting the post out of the hole.

The sliding motion of the first gripper along the lower cross member 31 can be limited if desired. One way to do this is to place a pin in one of a plurality of holes 48 in the lower cross member. When the sliding unit 45 encounters a pin in one of these holes, it will stop. This is especially useful when lifting studded steel fence posts because such posts can easily be damaged if subjected to too great a gripping force. Such posts are of uniform size and can be readily grasped without damage when the travel distance to closure is limited by an appropriately placed pin.

An object lying on the ground can be gripped and moved in a similar manner. In this case the operator may wish to use the lifting machine to tilt the frame toward a horizontal position to more conveniently grip the object.

Although the invention finds an application in placing and removing fence posts, it can also be used for gripping and moving other objects such as telephone poles, pipes, logs, or other heavy and awkward objects.

The pivotal mounting of the two grippers minimizes any possible damage to a fence post or other object being inserted into or removed from a hole by allowing for pivoting (rotation) of the post during vertical motion. This is a useful feature of the invention because a lifting machine typically lifts through an arc rather than linearly. If the post were rigidly attached to the frame, it too would be made to travel through an arc. The pivotal mounting of the grippers enables the post to move linearly—that is, in an essentially constant vertical orientation relative to the hole—while it is being raised out of or lowered into the hole.

In some embodiments the grippers 17 and 19 are positioned very close to the lower cross member 31 to minimize any gap between the grippers and the cross member and thereby prevent a slender post from getting wedged in between one of the grippers and the lower cross member.

Various sizes and shapes of grippers may be used depending on the size, shape and weight of the object to be lifted. In the embodiment shown in the drawings, the second gripper has a round planar surface 51 with a diameter of about eight inches, slightly recessed within a lip 53. This configuration has been found to work well with various kinds of posts. A pipe-vice gripper having vertical grooves could be used for gripping iron pipes. Other sizes and shapes of grippers could also be used as desired.

By means of a lifter embodying the invention, a single worker can traverse an existing fence row, removing the posts one by one and dropping each on the ground near the hole. Later the posts can be retrieved, or if the fence is being replaced, the posts can be repositioned in their holes.

Although several embodiments of the invention have been described and illustrated, the invention is not to be limited to the specific forms or arrangements of parts so described and illustrated. The invention is limited only by the claims.

The invention claimed is:

1. Apparatus for lifting a workpiece, the apparatus comprising:

a liftable frame, a first gripper slidingly carried by the frame, a second gripper affixed to the frame, a hydraulic actuator that urges the first gripper slidingly toward the second gripper to grip a workpiece between the two grippers whereby the workpiece is lifted when the frame is lifted, a first pivoting mount between the first gripper and the frame, the first pivoting mount comprising a sleeve carried by the frame and a shaft rotatably disposed in the sleeve, and a second pivoting mount between the second gripper and the frame.

2. Apparatus for lifting a workpiece, the apparatus comprising:

a liftable frame, first and second grippers carried by the frame, the first gripper comprising a sleeve slidingly carried by the frame, a shaft rotatably disposed in the sleeve, and a gripping surface for engaging a portion of a workpiece, the gripping surface affixed to the shaft, the gripping surface defining a plane approximately perpendicular to a longitudinal axis of the shaft, and means for urging the first gripper toward the second gripper to grip the workpiece between the two grippers, the grippers pivotable relative to the frame so that the workpiece remains in an approximately constant angular orientation as the frame is lifted.

3. Apparatus as in claim 2 wherein the means for urging comprises an electric motor.

4. Apparatus as in claim 2 wherein the means for urging comprises a pneumatic actuator.

5. Apparatus as in claim 2 wherein the means for urging comprises a hydraulic actuator.

6. Apparatus as in claim 2 wherein the frame is adapted to be lifted by a lifting element of a vehicle.

7. Apparatus as in claim 2 wherein the first gripper is slidingly mounted to the frame.

8. Apparatus as in claim 7 wherein the second gripper is slidingly mounted to the frame.

9. A post extractor comprising:

a frame adapted to be lifted by a hoisting device, first and second grippers carried by the frame, pivotable relative to the frame, and adapted for receiving a vertically-oriented post between the grippers, the first gripper comprising a sleeve carried by the frame, a shaft rotatably disposed in the sleeve, and a gripping surface affixed to the shaft, the gripping surface defining a plane approximately perpendicular to a longitudinal axis of the shaft, and means for urging the first gripper toward the second gripper to grip the elongated post between the two grippers, the grippers operative to pivot relative to the frame as the frame is lifted and thereby maintain the post in an approximately constant vertical orientation during lifting of the frame.

10. A post extractor as in claim 9 wherein the means for urging comprises a hydraulic actuator.

11. A post extractor as in claim 9 wherein the means for urging comprises an electric motor.

12. A post extractor as in claim 9 wherein the means for urging comprises a pneumatic actuator.

13. A post extractor as in claim 9 wherein the first gripper is slidingly mounted to the frame.

14. A post extractor as in claim 13 wherein the second gripper is slidingly mounted to the frame.

15. A post extractor as in claim 9 wherein the frame comprises a cross member that restrains the post from tipping away from a vertical orientation as the frame is lifted.

* * * * *